US007048761B2

(12) United States Patent
Ajili

(10) Patent No.: US 7,048,761 B2
(45) Date of Patent: May 23, 2006

(54) BREAST AUGMENTATION APPARATUS AND METHOD OF USE

(76) Inventor: Farideh Salehi Ajili, 27715 Blossom Hill Rd., Laguna Niguel, CA (US) 92677

( * ) Notice: Subject to any disclaimer, the term of this patent is extended or adjusted under 35 U.S.C. 154(b) by 0 days.

(21) Appl. No.: 10/803,429

(22) Filed: Mar. 17, 2004

(65) Prior Publication Data

US 2004/0192164 A1 Sep. 30, 2004

Related U.S. Application Data

(60) Provisional application No. 60/455,430, filed on Mar. 18, 2003.

(51) Int. Cl.
*A61F 2/52* (2006.01)

(52) U.S. Cl. ..... 623/7

(58) Field of Classification Search ..... 623/7–8; 450/38, 81, 36.81; 40/746; 602/41
See application file for complete search history.

(56) References Cited

U.S. PATENT DOCUMENTS 1,969,188 A * 8/1934 Spicer ..... 606/216
2,844,151 A * 7/1958 Lemons ..... 450/53
3,863,640 A * 2/1975 Haverstock ..... 606/216
3,983,878 A * 10/1976 Kawchitch ..... 606/167
4,106,130 A * 8/1978 Scales ..... 623/20.11
4,531,521 A * 7/1985 Haverstock ..... 606/215
4,550,450 A * 11/1985 Kinnett ..... 623/20.11
5,116,675 A * 5/1992 Nash-Morgan ..... 428/343
5,133,754 A * 7/1992 Laghi ..... 623/16.11
5,613,503 A * 3/1997 Penner ..... 128/892
5,755,232 A * 5/1998 Kalt ..... 128/845
6,080,179 A * 6/2000 Gould ..... 606/204.45
6,277,150 B1 * 8/2001 Crawley et al. ..... 623/17.18
6,379,386 B1 * 4/2002 Resch et al. ..... 623/19.13
6,603,051 B1 * 8/2003 Beaudry ..... 602/41
6,857,935 B1 * 2/2005 Dohan ..... 450/81
2005/0037689 A1 * 2/2005 Gorski et al. ..... 450/81

* cited by examiner

*Primary Examiner*—Suzette J-J Gherbi
(74) *Attorney, Agent, or Firm*—Gene Scott; Patent Law & Venture GP.

(57) ABSTRACT

A narrow linear near vertical fold is formed in the lower portion of a female breast and its lips are held in abutment adhesively. A curved contact member configured for abutting the lower portion of a female breast is positionable below a nipple of the breast along the fold. A rigid pressure rib protruding from the contact member is inserted into the fold so as to cause the breast to expand upwardly forming a convex topper surface on an upper portion of the breast. The contact member is adhesively attached to the exterior surface of the breast. Other means for accomplishing the same result may be applied.

13 Claims, 9 Drawing Sheets

BREAST AUGMENTATION APPARATUS AND METHOD OF USE

RELATED APPLICATIONS

This application claims the priority date of a prior filed U.S. Provisional patent application having Ser. No. 60/455,430 and filing date of Mar. 18, 2003 and entitled: Secret Bra.

BACKGROUND OF THE INVENTION

Incorporation by Reference

Applicant(s) hereby incorporate herein by reference, any. and all U.S. patents and U.S. patent applications cited or referred to in this application.

FIELD OF THE INVENTION

This invention relates generally to methods and devices for shaping and uplifting the female breast, and more particularly to such methods and devices capable of aggressively reshaping and supporting the breast without taking leverage from another part of the anatomy and while being nearly invisible.

DESCRIPTION OF RELATED ART

The following art defines the present state of this field:

De Beys, U.S. Des. 294,650 describes a self-adhesive breast supporting article design.

Xanthakis, U.S. Des. 338,771 describes a breast support design.

Herbener, U.S. Pat. No. 2,563,241 describes a pad having an outer face which is convex at least in part, said pad including a lower pad portion and an upper pad portion, the lower pad portion being thicker and vertically longer than the upper pad portion, the lower pad portion having an inner face which is vertically convex and the upper pad portion having an inner face an inner face which is vertically convex and the upper pad portion having an inner face which is vertically concave, the pad being provided upon its inner face adjacent to the top of the lower pad portion with a recess to receive the natural nipple, the lower thick pad portion serving to elevate and support the bust and extending substantially to the body, the upper short pad portion terminating a considerable distance from the body so that the upper portion of the bust is uncovered by the upper pad portion.

Ullian, U.S. Pat. No. 2,834,352 describes a brassiere pad comprising a cup-like body of soft yieldable material, said body having a rounded upper peripheral edge and a rounded lower peripheral edge, the lower portion of the cup body being of greater thickness than the upper portion to form an enlarged lift portion, said lift portion including a pair of spaced rounded lift members disposed at side portions of the body, said members having curved receding portions extending to the lower peripheral edge of said body, and said receding portions, intermediate the members, uniting in a central relatively thick supplemental lift materially less in thickness than and bridging said members.

Lemons, U.S. Pat. No. 2,844,151 describes a bust supporter comprising: a pair of bodies, each formed of a soft, self-sustaining resilient material; and an elongate U-shaped resilient wire element, the legs of said elements being turned upwardly with each of the ends thereof embedded, respectively, in one of said bodies; the ends of said elements being curved for anchorage of the two bodies to the element end for internal reinforcement of said bodies, the bight section of said U-shaped wire element having an upward offset to extend between the two breasts of the wearer at the lower side of said breasts, said wire element being so dimensioned as to hold said bodies in compressive engagement with the lateral and under-surface of the breasts, said bodies applying to said breasts upwardly and inward directed forces thereby to displace the two breasts upwardly and towards each other to increase the upward bulge of the two breasts and to narrow and accentuate the cleavage between the two breasts.

Beals, U.S. Pat. No. 3,494,365 describes a breast pad comprising an envelope having a convex front wall and a rear wall for engaging the outer surface of a human breast, said walls being of tough, flexible material and forming the envelope, and a mass of soft material enclosed within said envelope and substantially completely filling said envelope, said walls including wall portions projecting into said soft material and decreasing the efficiency of said envelope to a level imparting the general pressure displacement properties of a human Bosom to the filled envelope whereby the pad is provided with generally the consistency of a human bosom.

Mellinger, U.S. Pat. No. 3,934,593 describes a soft, pliable, strapless breast support comprised of a plastic foam sandwiched between a soft woven or knitted fabric. The support has a somewhat semi-circular shape with upward extending tabs and a specially contoured upper edge to form a cushioned cup, which conforms to the shape of the breast when worn. The fabric is adhesively bonded to the plastic foam and a firm, flat border formed by applying heat under pressure. The border is coated with an adhesive, which will adhere to skin.

Le Jeune, U.S. Pat. No. 4,343,313 describes a brassiere comprised of two symmetrical elements, each supporting one breast. The element comprises a wide part adhesively positioned under the breast and/or on the side, and a thin shoulder-strap adhering, at least at the end, to the back part of the shoulder. The brassiere may be attached to clothing, if desired, to support the same.

Diaz, U.S. Pat. No. 4,992,074 describes a soft, reusable, self-supporting bra comprised of two independent shaped forms having a plastic foam construction, and are formed so as to have the desired shape. The forms may be worn underneath a conventional bra or bathing suit and are completely washable. Self-adhesive strips are included to hold the bra forms to the wearer. The strips are cut so as to overlay part of the bra, holding the bra forms in place without adhering to the wearer's breast skin.

Kalt, U.S. Pat. No. 5,755,232 describes an anatomical support device that lifts, supports and stabilizes various parts of the human anatomy preferably utilizing a medical grade, hypoallergenic, removable tape base plate covered by a water resistant, sterilizable support fabric. The fabric is preferably a porous, non-woven material and/or loop material having sufficient tension and resiliency to gently support and stabilize nasal tissue to allow improved air flow without nasal irritation. When applied to other body parts, the device lifts and supports tissue to enhance appearance and well being.

Gatto et al., U.S. Pat. No. 6,402,585 and U.S. 2002/0072295 describes a breast support system for a large breasted woman that is used in conjunction with a brassiere to uplift and laterally displace the breasts. The unique design redistributes the weight of the breasts, so that the back and neck fatigue normally experienced by women with large breasts is relieved.

Nadsady et al., U.S. Pat. No. 6,544,100 describes a push-up bra having an envelope between the front panel and the rear panel of the bra cups that receives a flexible pouch containing a mixture of water and a hygroscopic agent such as 70% glycerine-30% water. The hygroscopic agent will draw moisture into the envelope preventing the volume of liquid from decreasing.

DeMarco, U.S. 2001/0021620 describes a reusable backless, strapless, one-piece bra. The bra comprises an underwire, a light-weight aluminum layer and a rubber foam layer, the light weight aluminum layer being positioned between foam rubber layers. The aluminum enables the bra to be molded to fit the contours of each person. The foam is bonded to the skin with double-sided, disposable dermal adhesive tape. The tape is applied horizontally across the bottom of the bra and attached to the rib cage just beneath the breast. A pad may be provided on an inner surface of the bra to give the appearance of enhanced breast size.

Valentin, U.S. 2001/0027079 describes a strapless and backless bra that can be worn with backless or revealing clothing. The bra includes a first and a second cup each having: 1) an open top end; 2) a closed bottom end; 3) an outer side and an inner side each having substantially parallel upper portions; and 4) a tab, positioned proximate the outer side of the cup. The upper portions of the inner sides of each cup are directly connected/joined together. In addition, the bra may include a rigid underwire/supporter and a rigid reinforcement member for enhancing the appearance of a user's breasts while providing uniform lift and support.

Pinna, U.S. 2002/0187727 describes a self-sustaining female breast support, formed from a thin, flexible, soft, elongate sheet of shaped profile made from synthetic material, one of its surfaces being at least partly covered by a thin layer of skin-compatible adhesive, on its other surface there resting an elongate sprung bar formed of semi-rigid synthetic material, its two ends being fixed to the flexible sheet, the adhesive layer being made to adhere to the lower part of the breast, which is widened and maintained raised by the action of the sprung bar in the manner of a leaf spring.

Our prior art search with abstracts described above teaches: a push-up bra pad, a breast pad, a strapless breast support, a strapless and backless bra, a reusable strapless and backless bra, a self-sustaining female breast support, a breast support system, an artificial bust, brassiere pads, a universal anatomical support device and method of using same, and a reusable self-supporting brassiere, but does not teach a miniature breast shaping and supporting device and method of in-folding a breast to reconfigure it into a more desirable shape while leaving only a single fold line that is relatively unnoticeable and may be easily concealed. The present invention fulfills these needs and provides further related advantages as described in the following summary.

SUMMARY OF THE INVENTION

The present invention teaches certain benefits in construction and use which give rise to the objectives described below.

Due to the process of nursing and also to simple aging and natural shape of the female breast changes. It has been found desirable, through the ages, to reconfigure the female breast to regain its natural youthful shape and form. As shown in the prior art described above, this has been accomplished using various clothing articles and devices, most importantly the bra. In order to lift the breast and to enable it to have a fuller appearance, especially on its top surface, which is often displayed when in public, the devices and bras in the prior art have shown it to be advantageous to press inwardly on the bottom surface of the breast which causes the breast to push upward and to fill out the top surface. This is very well known.

The present invention is an extension of this approach, but differs significantly by, instead of pushing on the lower surface of the breast in general as with a pad or the convex undersurface of an uplift bra, the present invention has found that it is possible to press the undersurface of the breast inward with a narrow rib to cause a narrow fold to form, so as to accomplish the same and even improved results because it allows the breast to lie to the left and right of the fold in a fuller appearance. The present method also teaches that a rib or other thin or narrow impressing device is unnecessary, in that with a narrow fold formed in the underside of the breast, and the lips of the fold forming a line held in place by an adhesive tape or the like, the fold can be sustained and the reshaped breast can be enjoyed for as long as desired. This is a truly innovative concept and forms the basis of the novelty of the present invention, both to method as well as the several apparatus that are applied in embodiments of the invention.

In its best mode, the invention is a method of pressing a narrow fold into the lower portion of the female breast, and thereby uplifting the breast and causing an upper surface thereof to become more full and preferably, convex in shape. To accomplish this, the invention uses several devices including primarily, a curved contact member configured for abutting a lower portion of a female breast positionable between a nipple and a chest surface below the breast. A rigid pressure rib protruding from the contact member is inserted into an inward fold in the lower portion of the breast so as to cause the female breast to expand upwardly forming a convex topper surface on an upper portion of the female breast. The contact member is held in place by an adhesive surface and enables the breast to have a more appealing conformation; Other means for accomplishing the same result may be applied as further described.

A primary objective of the present invention is to provide an apparatus and method of use of such apparatus that yields advantages not taught by the prior art.

Another objective is to provide such an invention capable of shaping the breast to a more uplifted and youthful appearance without the use or fabrics, pads, straps or cups.

A further objective is to provide such an invention capable of being easily pushed against the lower portion of the breast mass to reconfigure it, and to hold it in place.

A still further objective is to provide such an invention capable of causing the breast to have a more youthful appearance without impressing any object into the breast tissue and without the use of any fabric such as a bra.

A still further objective is to provide such an invention capable of causing the breast to have a more youthful appearance without leveraging the breast against any other part of the anatomy such as the shoulders, the chest wall, the neck and so on.

A still further objective is to provide such an invention capable of a full range of shaping, lifting and directing of the female breast.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

Figure 1A:
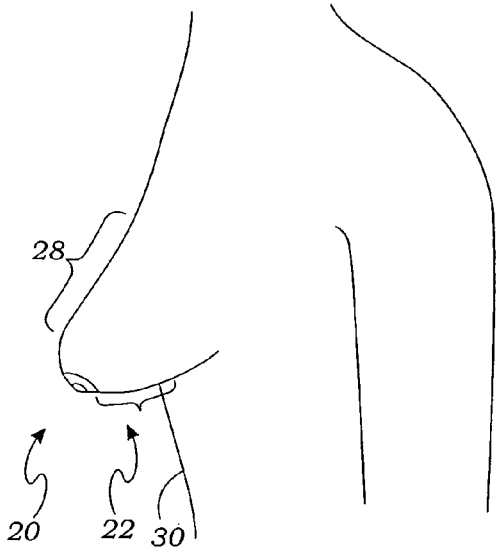
FIG. 1A is a side elevational view of a female breast showing the breast's natural shape when not engaged with a bra or similar device.
Figure 1B:
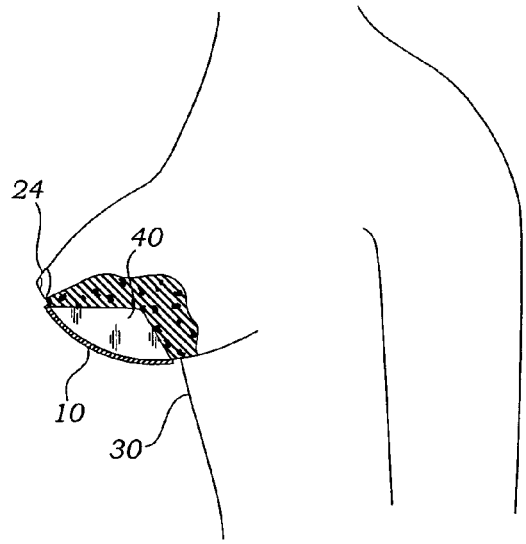
FIG. 1B is a side elevational view thereof in partial cutaway, showing the placement of an apparatus of the invention into a fold made in the lower portion of the breast, and the uplifted shape of the breast caused thereby.
Figure 2A:
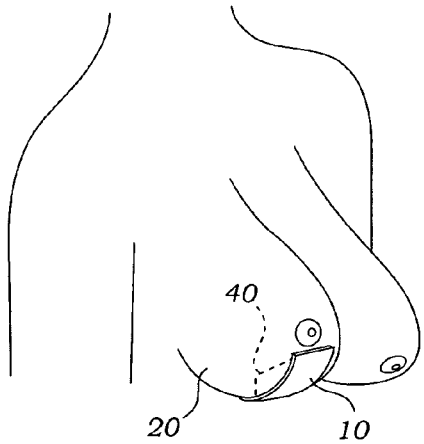
FIG. 2A is a perspective view of the enablement of FIG. 1B.
Figure 3A:
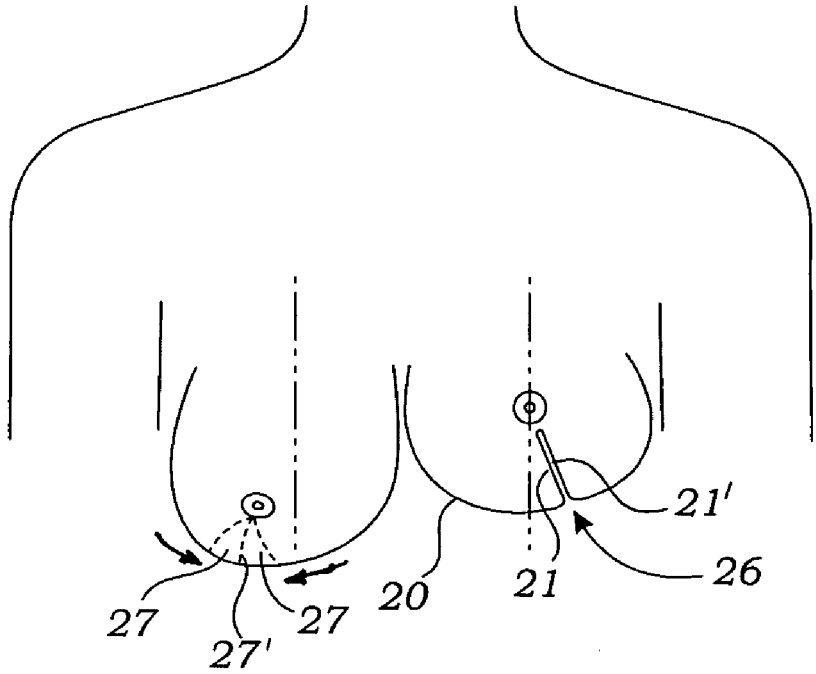
FIG. 3A is a frontal elevational view thereof showing a breast with lateral surfaces that will be folded inwardly along a central fold line and a breast showing the fold placement for causing the breast to move from a outwardly directed attitude to a central attitude.
Figure 3B:
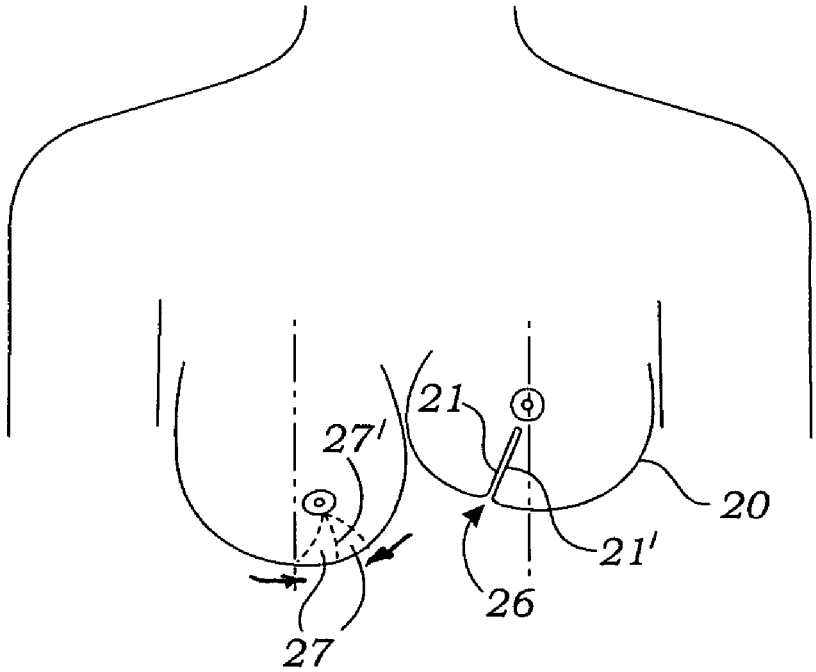
FIG. 3B is similar to FIG. 3A for moving a breast from an inwardly directed attitude to a more central attitude.
Figure 4:
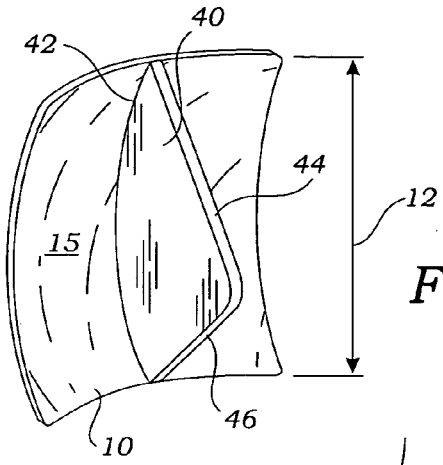
FIG. 4 is a perspective view of the apparatus as shown applied in FIGS. 1B and 2A.
Figure 5:
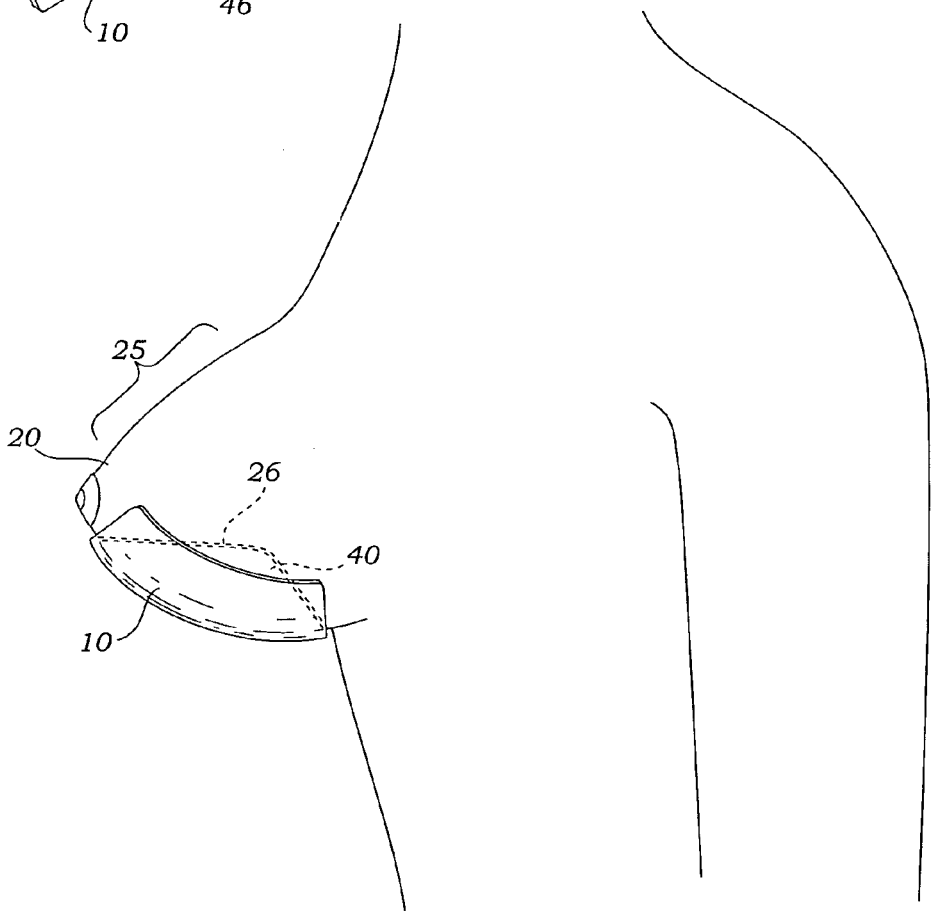
FIG. 5 is a side elevational view similar to that of FIG. 1B.

The present invention as shown in FIGS. 1B, 2A and 4, in one embodiment, is an apparatus comprising a curved contact member 10 configured in shape for intimately abutting a lower portion 22, of a female breast 20. The contact member 10 is preferably positionable under the nipple 24 of the female breast 20 and extends downwardly toward the bottom of the female breast 20, thereby defining a length 12 of the contact member 10 that is sufficient to support the lower portion 22 of the breast 20. Preferably, centered on, normal to, and integral with, the contact member 10, a relatively narrow rigid pressure rib 40 extends away from the contact member 10. The pressure rib 40 is configured for being inserted into an inward fold 26 in the lower portion 22 of the female breast 20 so as to cause the female breast 20 to expand upwardly forming a fuller appearance on its topper surface 25 (FIG. 5). The breast surfaces that form the interior side walls of the fold 26 are taken from the lower exterior surface of the breast 20 in a roughly triangular area shown in FIGS. 3A and 3B on the right side breast as element 27. This triangular area is split along line 27', and it is this line 27' that is pressed inwardly into the breast 20 by side 44 of rib 40 to form the fold 26. The rib 40 is shaped to cause the triangular area 27' to form the interior surface of the fold 26. Clearly, the rib 40 may be of a any size to enable the breast 20 to be more or less aggressively changed in its contour and to accommodate larger and smaller breasts 20. Preferably, the pressure rib 40 is used to create the inward fold 26 as the pressure rib 40 is pushed inwardly against the lower portion 22 until the contact member 10 touches the exterior surface of breast 20, as shown in FIG. 5. However, the fold 26 may be formed using other techniques. The fold 26 is thereby caused to have approximately parallel sides walls and abutting or near abutting lips 21, 21' as shown in FIGS. 3A and 3B.

The apparatus of FIG. 4 is preferably made of an injection molded, light weight plastic material such as polyester or polycarbonate resin and may be advantageously transparent. Preferably the contact member 10 has an adhesive surface 15 (FIG. 4) for holding the contact member 10 in place against the breast 20, and this secures the fold 26.

Figure 2B:
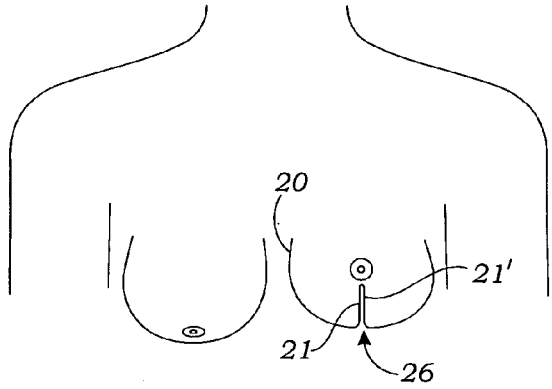
FIG. 2B is a frontal elevational view showing the fold made in a breast by the apparatus of FIG. 2A.

It can be seen by comparing FIG. 1A with FIG. 1B that the above described embodiment pushes the breast 20 upward by displacing lower breast tissue inwardly and upwardly. This may result in converting the upper breast surface 28 from a concave form, shown in FIG. 1A, into a more convex form, as shown in FIG. 1B, or at least to a less concave form; and causes the nipple 24 to be raised upwardly as shown in FIGS. 2A and 2B. FIG. 2B shows the conformation of the fold 26. Clearly, the fold 26 is not able to be maintained with out the apparatus of FIG. 4 or an alternate device. In FIG. 3A we see that the pressure rib 40 may be inserted into the breast 20 at an inwardly directed angle so as to move the breast 20 up and inward toward the center of the chest. In FIG. 3B we see that the pressure rib 40 may be inserted into the breast 20 at an outwardly directed angle so as to move the breast 20 up and outward away from the center of the chest.

Preferably, the pressure rib 40 extends over the length of the contact member 10, as shown in FIG. 4, but may be of lesser length as desired and is preferably of a triangular shape as shown, although this is not a restriction as other shapes may be used, such as a curved rib, a square rib, an oval rib and so on. In any case, the pressure rib 40 is a relatively thin planar plate in the preferred embodiment. When roughly triangular in shape the pressure rib 40 may approximate a right triangle-like shape with its curved hypotenuse 42 established by the intersection of the contact member 10 and the pressure rib 40. A longer one 44 of the two further sides of the triangle is positioned above a shorter one 46 of the sides, as can be seen in FIG. 4. This configuration has been shown to be critical to achieving the objectives of the invention because it forces more breast flesh upwardly as one moves along line 27' downward from the nipple 24.

Figure 6:
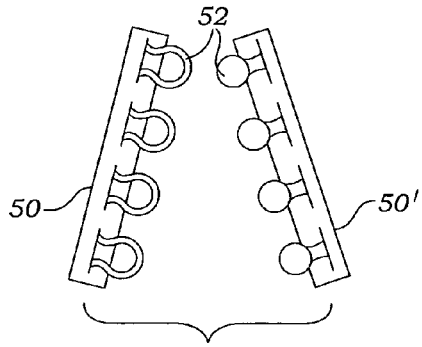
FIG. 6 is an elevational view of an alternate apparatus of the invention for use in the method of the invention.
Figure 7:
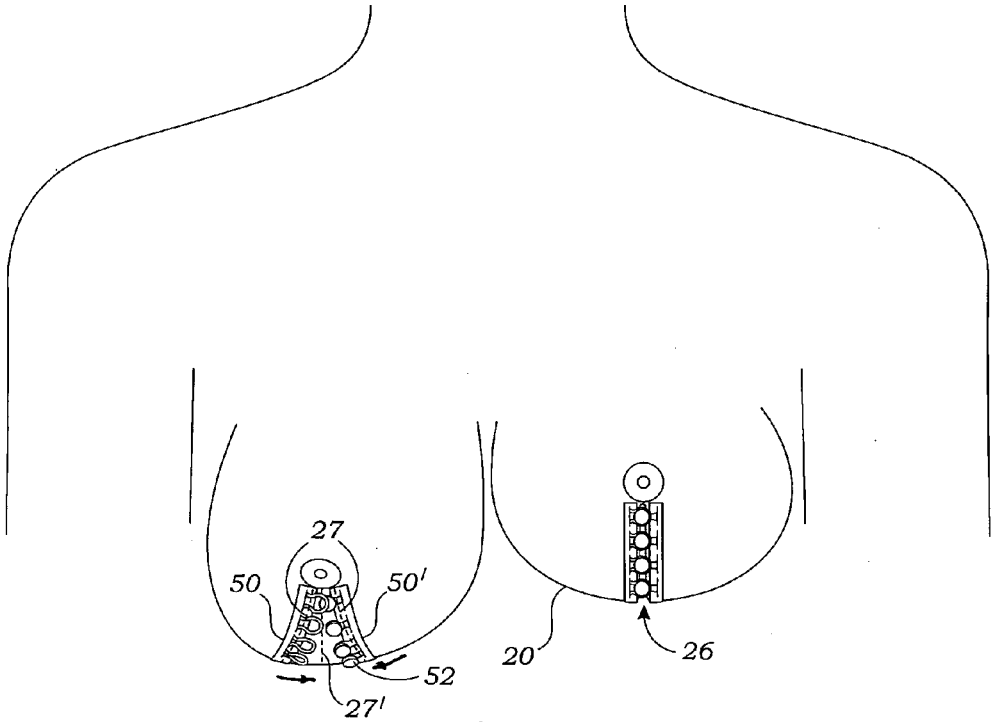
FIG. 7 is a frontal elevational view showing placement of the apparatus of FIG. 6 on a right breast prior to folding the breast, and the result of fastening the apparatus of FIG. 6 on a left breast after folding the breast, respectively using the method of the invention.
Figure 8:
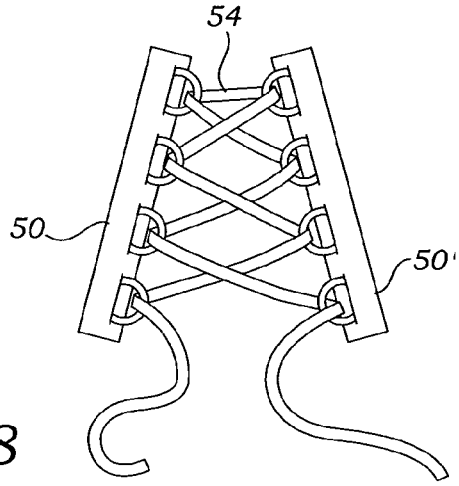
FIG. 8 is an elevational view of a further alternate apparatus of the invention for use in the method of the invention.
Figure 9:
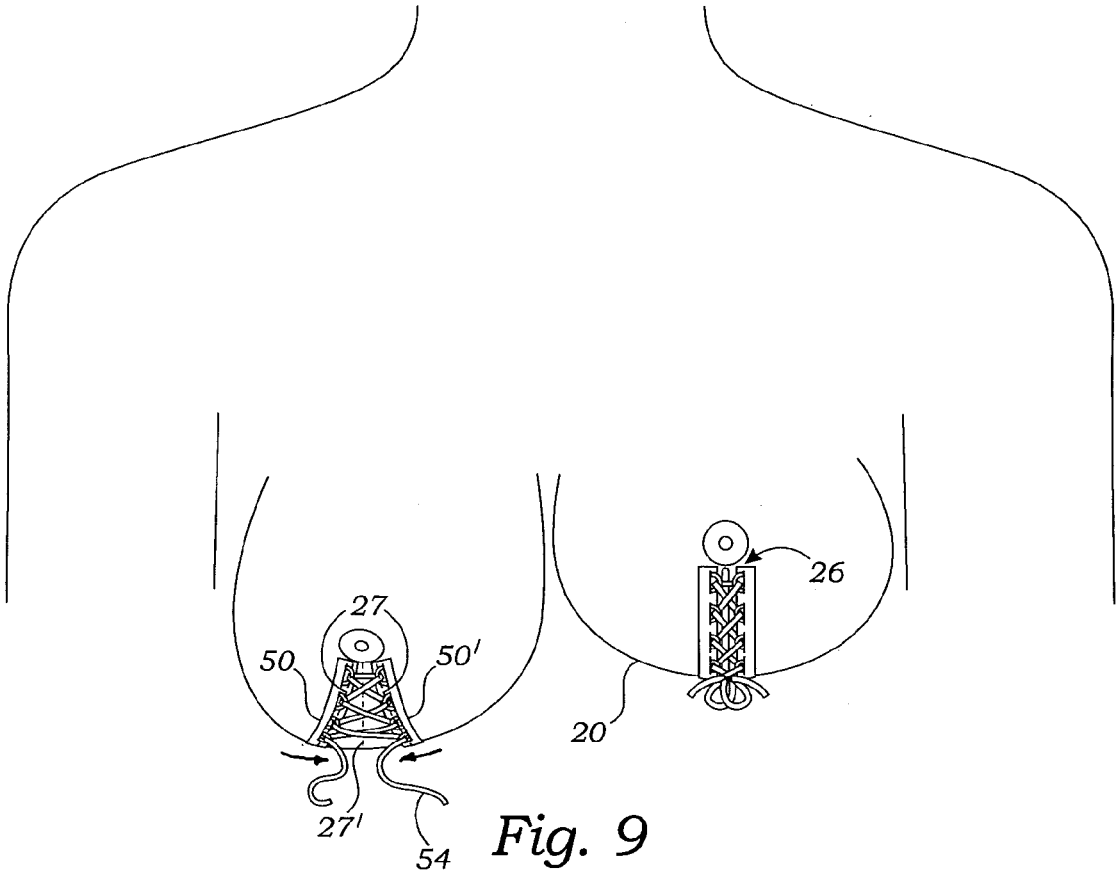
FIG. 9 is a frontal elevational view showing placement of the apparatus of FIG. 8 on a right breast prior to folding the breast, and the result of fastening the apparatus of FIG. 8 on a left breast after folding the breast using the method of the invention.

In an alternate embodiment, a pair of linear adhesive strips 50, 50', preferably, continuous cloth strips (FIG. 6), are positioned initially, as shown in FIG. 7 on the right breast. The strips 50, 50' placed so as to form an inverted V-shape, and of such length as to engage the lower portion 22 of the female breast 20 just outwardly of the triangle 27 and extensive from just below the nipple 24 downward to the bottom of the breast 20. The strips 50, 50' provide a means for mutual engagement, that is, drawing the strips 50, 50' together so as to be in near side-by-side positions as shown on the left breast in FIG. 7 and folding the breast tissue of triangle 27 inwardly as previously defined. When this occurs, the lower portion 22 of breast 20 is caused to fold inwardly so as to expand the breast tissue upwardly in general forming the convex topper surface 25 on the upper portion 28 of the female breast 20, as was described above. Preferably, the strips 50, 50' are joined by any one of: eye and hook fasteners 52, FIGS. 6, 7, laces 54, FIGS. 8, 9, horizontal adhesive strips 56, FIGS. 10, 11, or other fastening means such as snaps, hook and loop surface fastening material (not separately shown), and so on.

Figure 12:
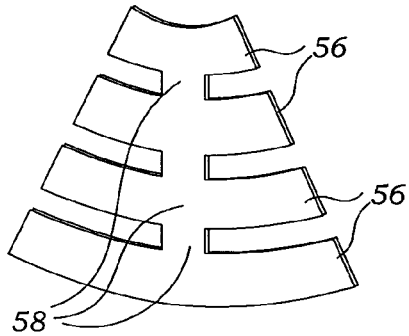
FIG. 12 is an elevational view of a further alternate apparatus of the invention for use in the method of the invention.
Figure 13:
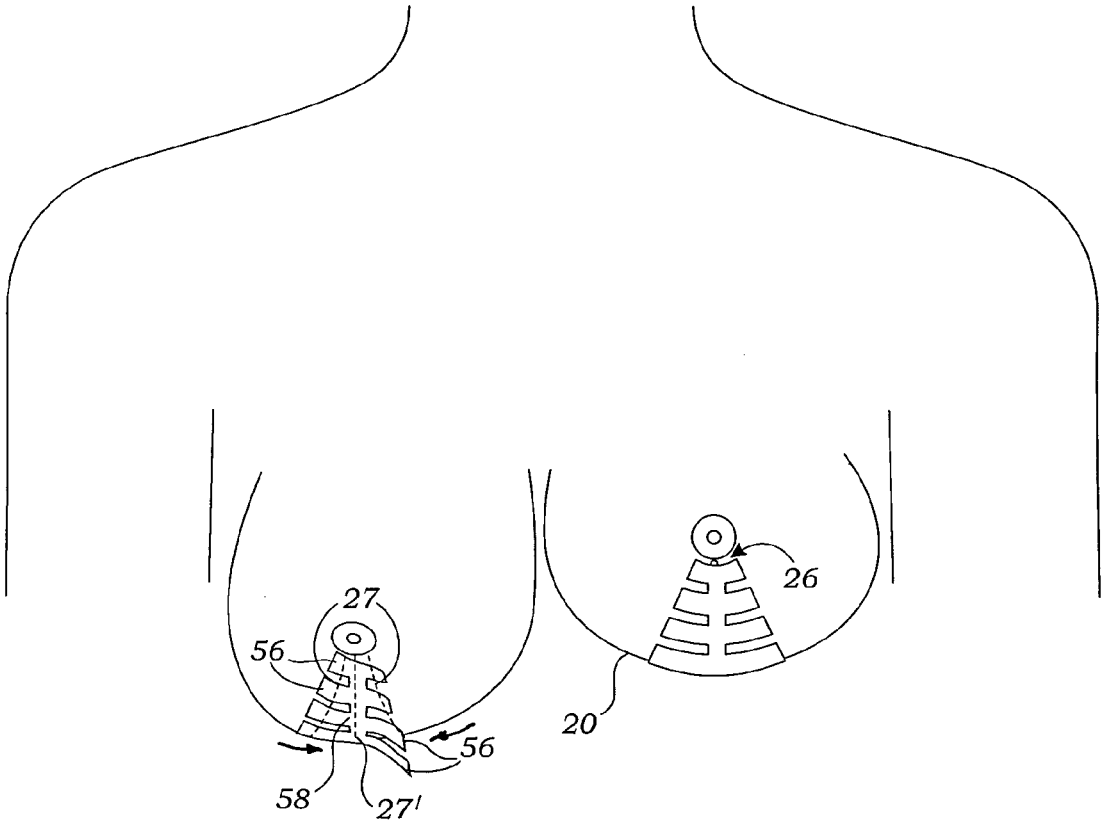
FIG. 13 is a frontal elevational view showing placement of the apparatus of FIG. 12 on a right breast prior to folding the breast, and the result of fastening the apparatus of FIG. 12 on a left breast after folding the breast using the method of the invention.

In another preferred embodiment, the horizontal adhesive strips are coextensive, as shown in FIG. 12, 13, making the strips easier to manage and easier to apply. As shown in FIG. 12 plural horizontal strips 56 are joined. The strips 56 are of increasing length downwardly and are preferably curved, as shown. A joining strip portion 58 connects the four strips 56 one above the next. To apply this set of horizontal adhesive strips, first, one side of each of the horizontal strips 56 is adhesively applied to the breast 20 in positions just to the outside of triangle 27 of the breast surface that will form the inward breast fold 26 as shown in FIG. 13, right breast. Next the breast fold 26 is formed. Finally, the other side of the horizontal adhesive strips 56 are applied to the breast surface on the alternate side of the fold 26, as shown in FIG. 13, left breast.

Figure 10:
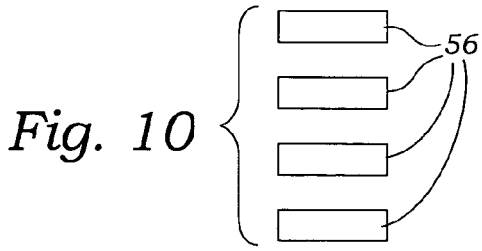
FIG. 10 is an elevational view of a further alternate apparatus of the invention for use in the method of the invention.
Figure 11:
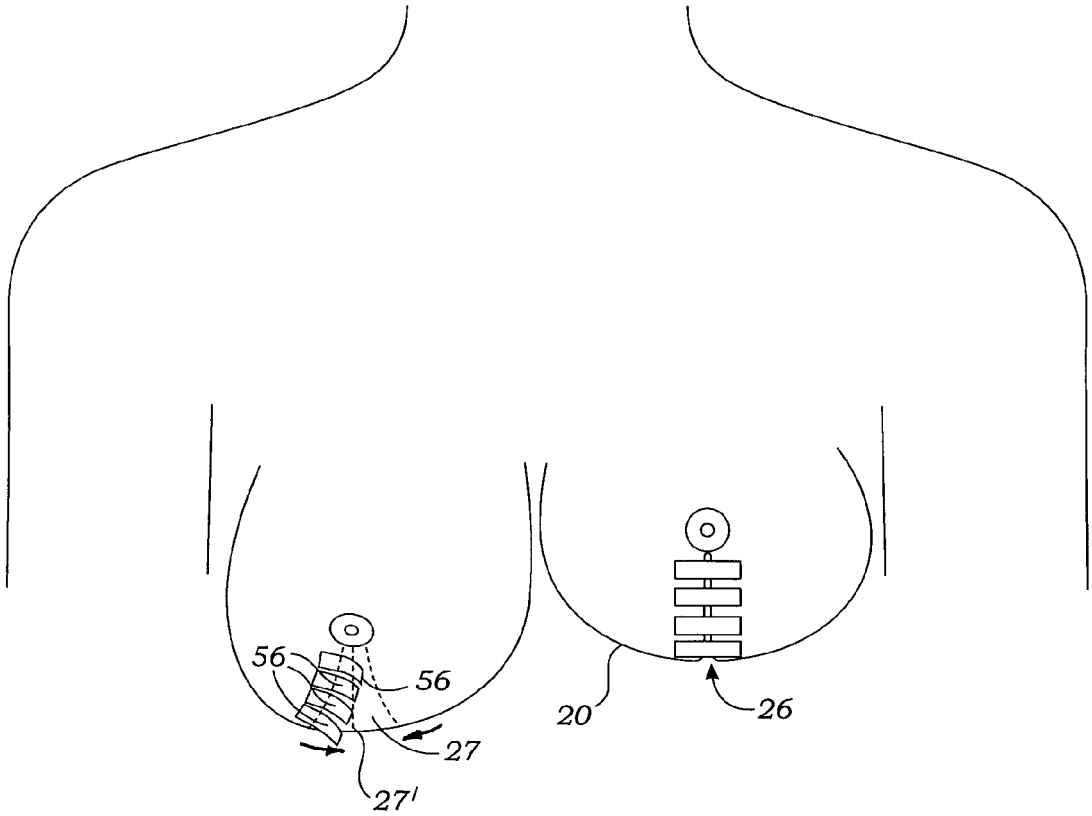
FIG. 11 is a frontal elevational view showing placement of the apparatus of FIG. 10 on a right breast prior to folding the breast, and the result of fastening the apparatus of FIG. 10 to the left breast after folding the breast using the method of the invention.
Figure 14:
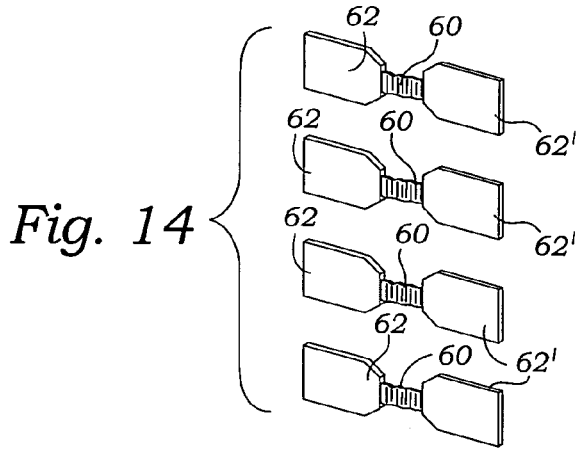
FIG. 14 is perspective view of a further alternate apparatus of the invention for use in the method of the invention.
Figure 15:
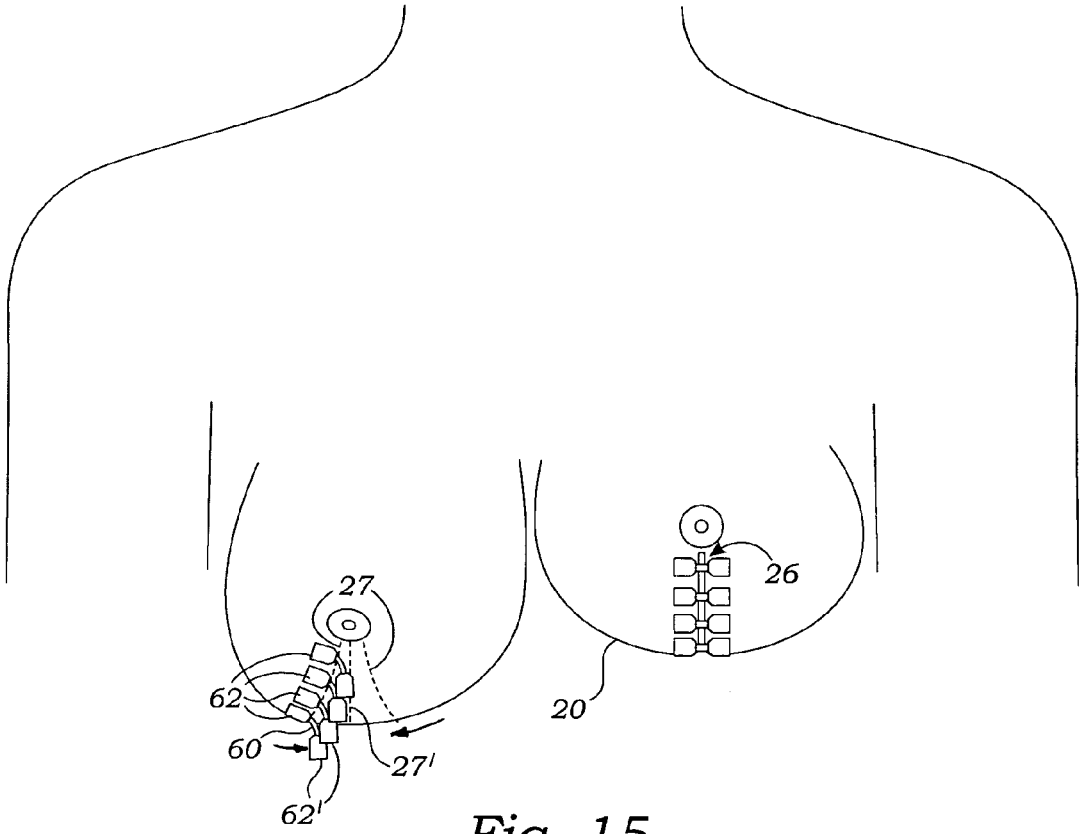
FIG. 15 is a frontal elevational view showing placement of the apparatus of FIG. 14 on the right breast prior to folding the breast, and, on the left breast, the result of folding the breast using the method of the invention.

In an alternate embodiment to that shown in FIGS. 10 and 11, the horizontal strips may preferably have opposing adhesive tabs 62, 62' separated by an elastic portion 60 as shown in FIGS. 14, 15, which, it has been found enables the breast to have a more natural motion in some cases, especially for larger breast sizes. In FIG. 15 the tabs 62, 62' are shown adhesively placed onto the right breast, but the fold 26 has not been formed as yet. The elastic portions 60 are stretched. The left breast shows the breast after the fold 26 has been formed and the elastic portions 60 have contracted thereby holding fold 26 in place.

Figure 16:
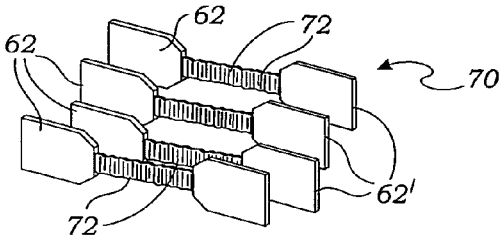
FIGS. 16 and 17 are perspective views of associated elements used with the invention.
Figure 17:
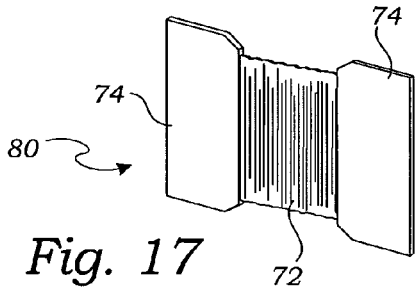
Figure 18A:
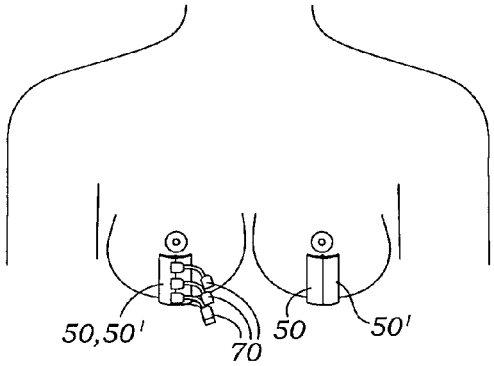
FIG. 18A is a frontal elevational view showing placement of the apparatus of FIG. 16 on the right breast after the breasts have been folded and the folds secured in accordance with the method of the invention.
Figure 18B:
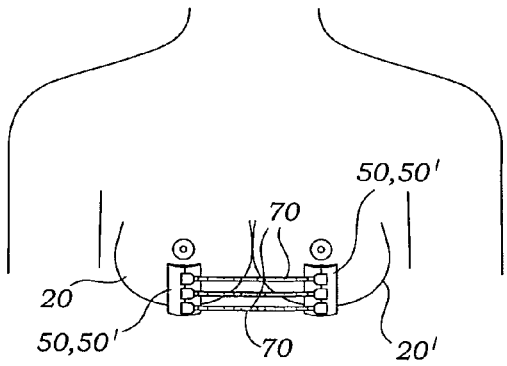
FIG. 18B is a frontal elevational view showing further placement of the apparatus of FIG. 16 on the left breast.

In an extension of the present invention, one or more strips as shown in FIGS. 16 and 17, which are similar to the strips of FIG. 14, may be used as shown in FIGS. 18A and 18B. Such strips have the tabs 62, 62' on either side. After the breasts 20 have been folded in accordance with the present invention with the folds held in place by strips 50, 50', with, for instance a length of adhesive laid over the strips 50, 50' when they have brought into side by side positions, tabs 62 may be applied to the right breast 20 as shown in FIG. 18A, and then tabs 62' may be applied to the left breast 20 as shown in FIG. 18B. This enables the two breasts to be connected in such a manner that the breasts are elastically controlled so that they influence the movement of each other.

Figure 19:
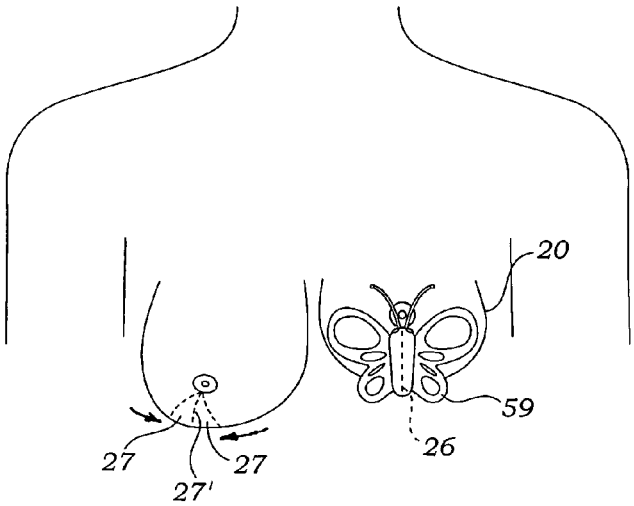
FIG. 19 is a frontal elevational view showing a right breast prior to placement of a further apparatus of the invention, and a left breast after folding the breast in accordance with the method of the invention and adhesive placement of the further apparatus to hold the fold in place.

FIG. 19 shows that a single adhesive piece or appliqué may be used to secure the fold 26 in place on a breast 20. In FIG. 19 it is shown that the single adhesive piece may be formed into a recognizable shape or may be printed to define a recognizable figure or symbol. With a little practice the butterfly, or equivalent single unitary adhesive appliqué 59 may be applied to the breast surfaces to either side of the fold 26. This can be accomplished more easily by using a rod or tongue depressor or other similar object to produce the breast fold 26 and then apply the appliqué 59 to hold it in place. In this process, with the fold 26 fully formed, the lower portion of the adhesive appliqué 59 is applied. Then, with the upper portion of the fold 26 held in place manually, the rod or equivalent object that is used to form the fold, is withdrawn and the upper portion of the adhesive appliqué 59 is pressed into place to fully secure the fold 26. The appliqué 59 may be large enough to cover the nipple 24 and the appliqué 59 may be flesh colored to be less obvious.

The method of the present invention has been described above, but to assure a full explanation it should be realized that the method includes the steps of forming the linear fold 26 in the lower portion 22 of the female breast 20, the fold 26 extensive from below a nipple 24 of the breast 20 downwardly into proximity with the bottom of the breast 20. The fold 26 defines opposing linear fold lips 21, 21' in joint side-by-side abutment, and securing the opposing fold lips 21, 21' is completed so that they cannot move apart.

The linear fold 26 is preferably made by impressing the pressure rib 40 or other object into the female breast 20 in the location described above, and then securing the fold lips 21, 21' by placing an adhesive tape 60 on the lower portion 22 of the female breast 20 over the lips 21, 21', or in the case of using the device of FIG. 4, of assuring contact between the adhesive 15 and the breast surface to each side of the lips 21 and 21'.

When, for instance a rod or tongue depressor, etc. is used to form the fold 26; after securement of the linear fold lips 21, 21', the rod is pulled out of the fold 26 along its own centerline in an axial motion. The fold lips 21, 21' are preferably secured in abutment by placing an adhesive tape over the lips, and this tape may be shaped in outline and my carry an indicia so as to assume a recognizable characteristic. See FIG. 19.

Alternately, the adhesive tape may be formed as a set of strips placed one above the next in a series of increased lengths as shown in FIG. 12. As shown, the strips are preferably formed contiguously for improved handling as described above.

After each of a woman's breasts 24 are pushed upward using the methods described herein it may be desirable to engage the two breasts 20 together so that the breasts move together and are restrained with respect to lateral motion. This is accomplished by tethering the breasts preferably with at least one elastic tether, as shown in FIGS. 18A and 18B.

In summary, the present invention apparatus and method is able to temporarily reconfigure the female breast 20 by creating a fold 26 in the lower portion of the breast 20 and the fold 26 preferably runs from shallow adjacent the nipple 24, to deeper as one moves downwardly away from the nipple 24. Further, the fold 26 may be produced and maintained by an impressed rib 40 or may be produced by any object held in place by a fastener, such as an adhesive tape, attached at the outer lips 21, 21' of the fold 26. These variables control the amount of uplifting of the breast 20, lateral positioning of the breast 20 and its actual cup size so that control of these variables is now possible. The result may be to create a desired shape with only a fold line visible on the lower portion of the breast, and this fold line is typically hidden by a skin colored cover or adhesive device, or by clothing, and may be decorated by a decorative cover.

Throughout the above description, several devices have been described for accomplishing the method of the invention. All of such devices may be made of transparent materials, semi-transparent materials and flesh colored materials so as to appear nearly invisible when in use. The use of the concept of adhesive tapes and adhesive surfaces have been used in the above description. It is considered to be well known that a device that is an adhesive device has a surface of adhesive material thereon and that such adhesive material, being so well known, need not be separately call-out or call attention to in the description in that one of skill in the art would have no trouble in knowing where and to what extend such adhesive would be placed and to know how to select an adhesive that is at once persistent for securing a breast, as well as easily applied and removed when the device is discarded or removed.

The enablements described in detail above are considered novel over the prior art of record and are considered critical to the operation of the instant invention and to the achievement of the above described objectives. The words used in this specification to describe the invention and its various embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of this described invention and its various embodiments are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A method for causing a female breast to expand upwardly, the method comprising the steps of: forming a linear narrow fold in a lower portion of the female breast, the fold positioned between a nipple of the breast and a bottom of the breast, the fold intrusive into the breast to an extent for causing a breast surface thereabove to expand upwardly the fold defining opposing linear fold lips in joint side-by-side abutment; and securing the opposing fold lips in abutment.

2. The method of claim 1 wherein the linear fold is made by impressing a pressure rib into the female breast, the securement of the fold lips is made by placing an adhesive tape over the fold lips.

3. The method of claim 1 wherein the linear fold is made by impressing a pressure rib into the female breast, the securement of the fold lips is made by taping a contact member integral with the pressure rib to the lower breast portion.

4. The method of claim 1 wherein the linear fold is made by impressing a rod into the lower breast portion, and after securement of the linear fold lips, removing the rod in an axial motion.

5. The method of claim 1 wherein the fold lips are secured in abutment by an adhesive tape.

6. The method of claim 5 wherein the adhesive tape is at least one of being shaped in outline and carrying an indicia so as to assume a recognizable characteristic.

7. The method of claim 5 wherein the adhesive tape is formed as a set of strips placed one above the next in a series of increased lengths.

8. The method of claim 7 wherein the strips are formed contiguously.

9. The method of claim 1 wherein the female breast is secured by tethering the female breast to an adjacent female breast with at least one elastic tether.

10. The method of claim 1 comprising the further step of controlling the depth and extent of the fold to achieve a desired degree of breast contour change.

11. An apparatus comprising: a non-rigid contact member configured for conforming to the surface of a lower portion of a female breast, the contact member having a size and shape for being positioned between, a nipple of the female breast and a bottom of the female breast; and, approximately centered on, approximately normal to, and integral with, the contact member, a relatively narrow triangle shaved, rigid pressure rib extending outwardly from the contact member with one side of the pressure rib intersecting the contact member, the rib thereby enabled for being pushed against the female breast producing an inward fold therein forming approximately parallel opposing wall surfaces in the breast, so as to cause the female breast to expand upwardly for producing a fuller appearance.

12. The apparatus of claim 11 wherein the triangle shape forms the inward fold progressively deeper downwardly away from the nipple.

13. The apparatus of claim 12 wherein the triangle shape is roughly a right triangle with the hypotenuse thereof established by the intersection of the contact member and the pressure rib; a longer one of a two further sides of the triangle positioned above a shorter one of the two further sides.

* * * * *